US005420934A

United States Patent [19]

Okamoto

[11] Patent Number: 5,420,934

[45] Date of Patent: May 30, 1995

[54] ELECTRONIC SOUND PROCESSING SYSTEM

[75] Inventor: Seiji Okamoto, Hamamatsu, Japan

[73] Assignee: Kabushiki Kaisha Kawai Gakki Seisakusho, Japan

[21] Appl. No.: 227,577

[22] Filed: Apr. 14, 1994

Related U.S. Application Data

[63] Continuation of Ser. No. 953,502, Sep. 29, 1992.

[30] Foreign Application Priority Data

Mar. 26, 1992 [JP] Japan ..... 4-068587

[51] Int. Cl.[6] ..... G10D 5/00

[52] U.S. Cl. ..... 381/118; 381/94

[58] Field of Search ..... 381/94, 61, 118; 84/603, 622, 625, 627

[56] References Cited

U.S. PATENT DOCUMENTS

| | | | |
|---|---|---|---|
| 3,473,150 | 10/1969 | McClelland . | |
| 4,132,141 | 1/1979 | Campbell et al. . | |
| 4,377,862 | 3/1983 | Koford et al. . | |
| 4,469,000 | 9/1984 | Fujiwara et al. . | |
| 4,567,804 | 2/1986 | Sawase et al. . | |
| 4,593,592 | 6/1986 | Stahnke . | |
| 4,622,682 | 11/1986 | Kumakura . | |
| 4,727,592 | 2/1988 | Okada et al. . | |
| 4,744,281 | 5/1988 | Isozaki . | |
| 4,779,274 | 10/1988 | Takahashi et al. . | |
| 4,800,548 | 1/1989 | Koishi et al. . | |
| 4,912,703 | 3/1990 | Sumida . | |
| 4,913,026 | 4/1990 | Kaneko et al. . | |
| 4,970,928 | 11/1990 | Tamaki . | |
| 5,016,513 | 5/1991 | Stahnke . | |
| 5,022,301 | 6/1991 | Stahnke . | |
| 5,072,644 | 12/1991 | Isozaki et al. . | |
| 5,083,491 | 1/1992 | Fields . | |
| 5,164,532 | 11/1992 | Ishii et al. . | |
| 5,196,639 | 3/1993 | Lee et al. | 84/603 |
| 5,210,367 | 5/1993 | Taguchi et al. . | |

FOREIGN PATENT DOCUMENTS

| | | |
|---|---|---|
| 53-20315 | 2/1978 | Japan . |
| 53-102020 | 9/1978 | Japan . |
| 54-17011 | 2/1979 | Japan . |
| 55-84088 | 6/1980 | Japan . |
| 58-18691 | 2/1983 | Japan . |
| 58-179894 | 10/1983 | Japan . |
| 61-128295 | 6/1986 | Japan . |
| 61-292431 | 12/1986 | Japan . |
| 62-15840 | 4/1987 | Japan . |
| 63-37395 | 2/1988 | Japan . |
| 63-131632 | 6/1988 | Japan . |
| 63-217908 | 8/1988 | Japan . |
| 63-44867 | 11/1988 | Japan . |
| 63-301997 | 12/1988 | Japan . |
| 64-44936 | 2/1989 | Japan . |
| 64-247666 | 9/1989 | Japan . |
| 64-291944 | 11/1989 | Japan . |
| 1-332912 | 12/1989 | Japan . |
| 91020797 | 4/1991 | Japan . |
| 3-194597 | 8/1991 | Japan . |
| 2164192 | 3/1986 | United Kingdom . |
| WO80/02886 | 12/1980 | WIPO . |

OTHER PUBLICATIONS

Partial translation of JP-03-020797, previously cited by examiner.

*Primary Examiner*—Forester W. Isen

*Attorney, Agent, or Firm*—Davis, Bujold & Streck

[57] ABSTRACT

An electronic sound processing system comprises a sound waveform looping apparatus which cuts out a portion of an input sound waveform and conducts a looping process for a predetermined cycle of the portion of the waveform. The sound waveform looping process comprises a discrete Fourier transformer for applying a discrete Fourier transform to the input sound waveform, a frequency band remover for removing a predetermined frequency band of the discrete Fourier transformed sound waveform, an inverse discrete Fourier transformer for applying an inverse discrete Fourier transform to the sound waveform from which the predetermined frequency band has been removed, and a looping processor for looping a predetermined cycle of the inverse discrete Fourier transformed sound waveform. By executing the sound waveform looping process, the electronic sound processing system can obtain smooth looped waveforms with easy processes and simple equipment.

9 Claims, 5 Drawing Sheets

PRIOR ART

ELECTRONIC SOUND PROCESSING SYSTEM

This is a continuation of application Ser. No. 07/953,502, filed on Sep. 29, 1992.

BACKGROUND OF THE INVENTION

This invention relates to an electronic sound processing system, and more specifically to an electronic sound processing system which executes a looping process on an input sound waveform.

A looping method or process performed on input sound or music waveforms by an electronic sound processing device is typically conducted by cutting out a predetermined cycle of a sound waveform and repeating the cycle thereby obtaining a looped sound waveform.

In prior art electronic sound processing devices such as a sampler, such a looping process is conducted by the following steps. First, approximately one cycle is cut out from a sound waveform shown on a display. Subsequently, connection points at which the cycle is expected to be smoothly looped or repeated are eye-estimated at the beginning and ending region of the cycle. The cycle is then repeated or looped at the connection points to become a looped waveform. In case the looped waveform is not smooth enough, the connection points are finely adjusted. The looped waveform thus obtaining goes through a low-pass filter (low-frequency passing filter) upon sound emission, thereby making the connection points having high frequency inconspicuous.

However, in the looping method adopted in the prior art sampler, connection points at which a cut out cycle of a waveform is smoothly repeated are not easily found, and thus a smooth looped waveform is rarely obtained. Therefore, a low-pass filter is necessary for removing the high frequency generated sound at the connection points at the time of sound emission, even if such a filter adds to the cost. Furthermore, since a smooth waveform is rarely obtained, the emitted tone quality of the looped sound waveform is not improved.

Japanese Published Examined Patent Application Nos. 61-39680 and 57-23278 disclose another type of electronic sound processing system such as an electronic piano and a synthesizer, which stores one cycle of a waveform to be looped in a ROM. In this electronic sound processing system, a looping process is conducted by the steps illustrated in FIGS. 5A through 5D. First, approximately one cycle T2 of a waveform shown in FIG. 5A is cut. Subsequently, as illustrated in FIG. 5B, a discrete Fourier transform is applied to the cycle T2. The discrete Fourier transform-applied waveform is then sampled at each angular frequency $\theta_0$. FIG. 5C shows sampling points at which the waveform is sampled. Finally, angular frequencies $\theta_0$ through $n\theta_0$ and sampled values A1 through An at the sampling points 1 through n, respectively, are converted into sine waves. The obtained sine waves are then summed up according to the following formula (1):

$$\sum_{k=1}^{n} Ak\mathrm{Sin}(2\pi k\theta_o t) \tag{1}$$

where $k\theta_0$ and Ak are the angular frequency and the value at the sampling point k, respectively. FIG. 5D shows a resulting one cycle T3 of the looped waveform. Since the frequencies of the summed sine waves are whole numbers times the angular frequency $\theta_0$, the cycle T3 can be smoothly repeated at the connection points.

However, the looping process and especially the sampling step of the process in the latter type of the electronic sound processing system requires special equipment and complicated techniques, even though a smooth looped waveform is obtained. Therefore, the latter electronic sound processing system can be operated only when a special apparatus for sampling sound waveforms and summing sine waves is provided. Even if such an apparatus happens to be available, the looping process is still complicated and bothersome.

SUMMARY OF THE INVENTION

Wherefore, an object of the present invention is to provide an electronic sound processing system which executes a looping process for selected input sound waveforms by employing simple devices and easy steps.

The foregoing and related objects of the invention are readily attained by the provision of an electronic sound processing system comprising sound waveform looping means which cuts out or selects a part of an input sound waveform and conducts a looping process for a predetermined cycle of the cut out part or portion of the waveform. As shown in FIG. 1, the sound waveform looping means comprises: discrete Fourier transform means for applying a discrete Fourier transform to the portion of the input sound waveform which has been selected; frequency band removal means for removing a predetermined frequency band of the sound waveform to which the discrete Fourier transform is applied by the discrete Fourier transform means; inverse discrete Fourier transform means for applying an inverse discrete Fourier transform to the sound waveform from which the predetermined frequency band has been removed by the frequency band removal means; and looping means for looping the predetermined cycle of the sound waveform to which inverse discrete Fourier transform has been applied by the inverse discrete Fourier transform means.

According to the electronic sound processing system thus constructed, the looping process is executed by the following steps. First, a part necessary for the looping process is cut out from the input sound waveform. A discrete Fourier transform is applied to the cut out portion of the waveform, thereby obtaining the relationship between the signal value at a discrete time and the spectrum value at a discrete frequency point. This relationship facilitates the next frequency-removal step. Then, an unnecessary frequency band of the waveform such as high-frequency band is removed by a computer or other device. An inverse discrete Fourier transform is applied to the waveform from which the unnecessary frequency band has been removed. Finally, the inverse discrete Fourier transform-applied waveform is looped. Since the unnecessary frequency band has been already removed, a smooth looped waveform results.

DETAILED DESCRIPTION OF A PREFERRED EMBODIMENT

Figure 1:
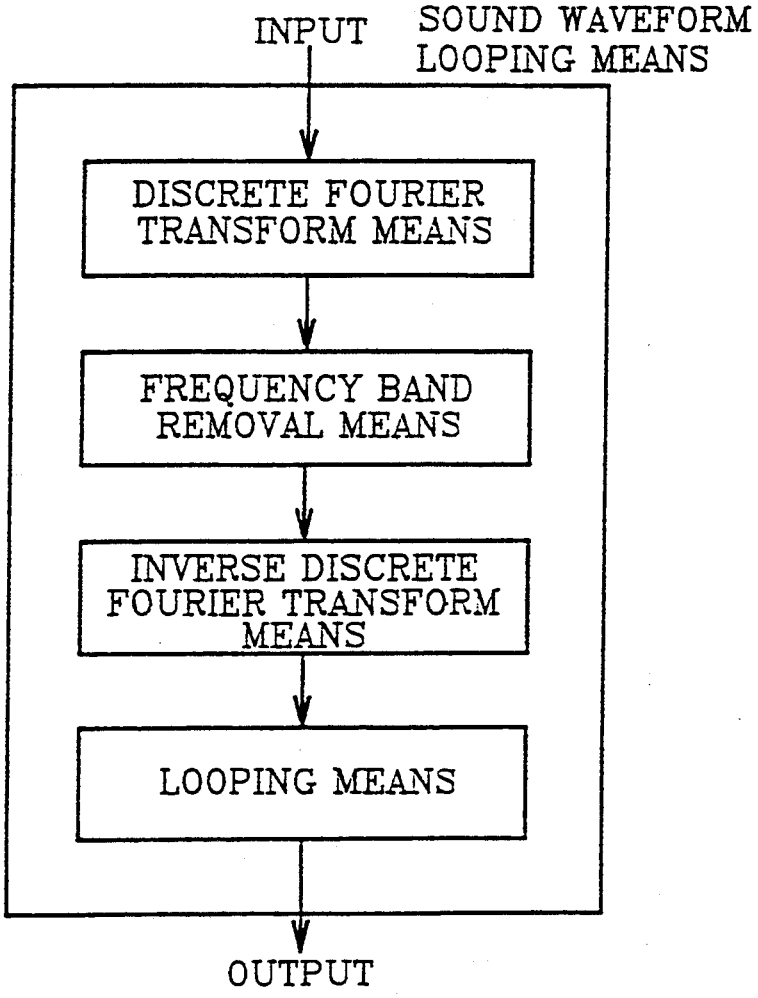
FIG. 1 is a block diagram of the structure of sound waveform looping means of an electronic sound processing system of the present invention.
Figure 2:
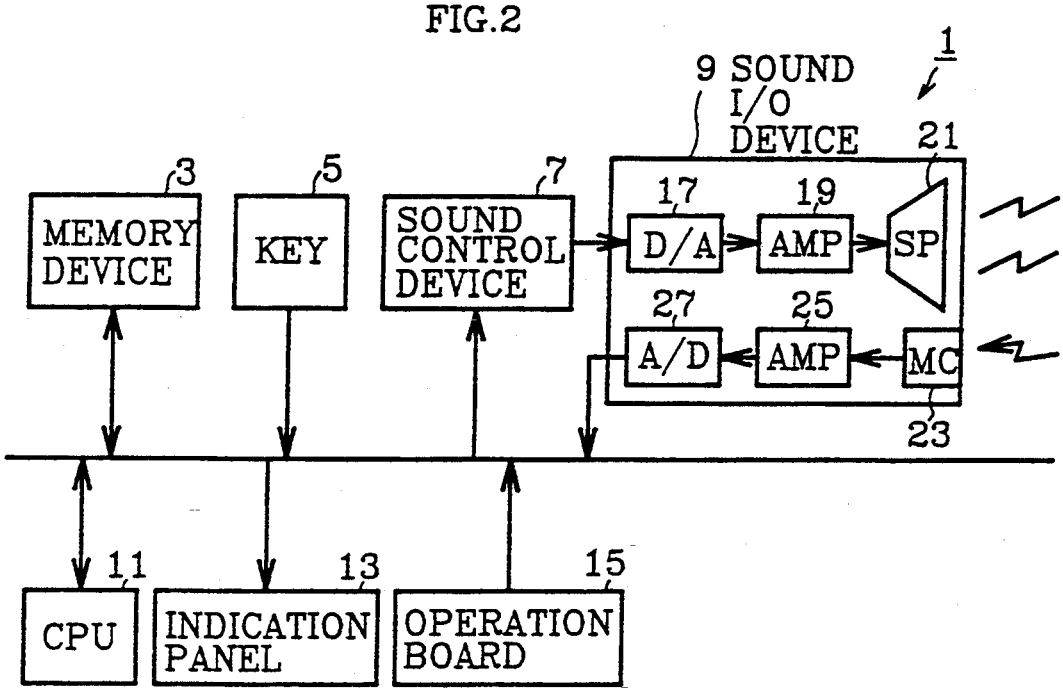
FIG. 2 is a diagrammatic block diagram of a sound sampler embodying the present invention.

As illustrated in FIG. 2, a sampler 1 includes among other components, a memory device 3, keys 5, a sound control device 7, a sound input/output device 9, a CPU 11, an indication panel 13, and an operation board 15. The memory device 3 stores sound waveforms and other data which are input from the sound input/output device 9 before the looping process, and sent from the CPU 11 after the looping process. The keys 5 are employed by the operator to emit sound from the sampler 1. The sound control device 7 is an electric circuit which functions as a part of looping process means. The sound control device 7 pitch-controls and/or reverberates the sound waveform entering through a bus, and sends the waveform to the sound input/output device 9.

The sound input/output device 9 is an interface circuit which sends out the sound waveform coming from the sound control device 7. The sound input/output device 9 includes a digital/analog convertor 17, a first amplifier 19, a loudspeaker 21, a microphone 23, a second amplifier 25, and an analog/digital convertor 27. The digital/analog convertor 17 receives the pitch-controlled and/or reverberated sound waveform from the sound control device 7 as digital signals, and converts the digital signals into analog signals. The first amplifier 19 electrically amplifies the analog waveform received from the digital/analog convertor 17. The loudspeaker 21 sends out the sound signals amplified by the first amplifier 19. The microphone 23 receives musical sound and other sound emitted from an outside sound source (not-shown), and sends the musical sound and other sound to the second amplifier 25 as analog signals. The second amplifier 25 amplifies the analog sound signals. The analog/digital convertor 27 converts the analog sound signals into digital signals.

In the present embodiment, the CPU 11 functions as the discrete Fourier transform means, frequency band removal means, and inverse discrete Fourier transform means, and also as a part of the looping process means together with the sound control device 7. The CPU 11 executes a looping process for the input sound waveform according to the control method described later.

The indication panel 13 is a liquid crystal panel which indicates the sound waveform and other data to be processed. The operation board 15 is provided with switches and the like which are employed by the operator to sample and select the sound and execute other processes.

The looping process executed by the CPU 11 will be now described. Before the looping process, the memory device 3 stores sound waveforms of sound signals in the form of digital signals entering from the sound source through the sound input/output device 9.

Figure 3:
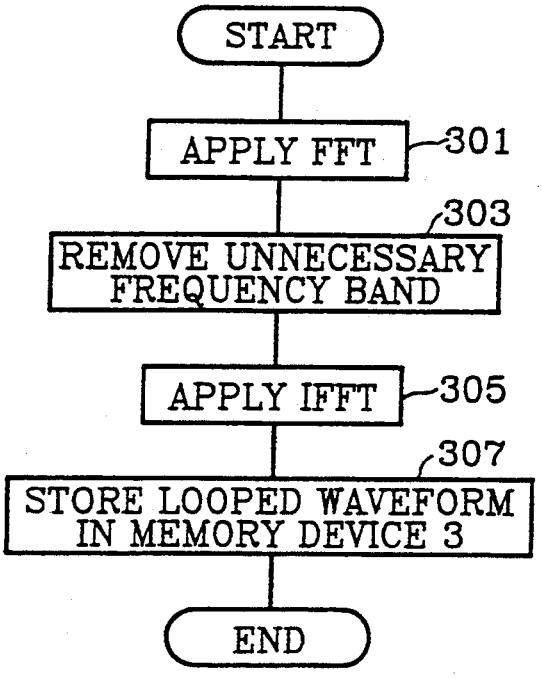
FIG. 3 is a flowchart showing a looping process for sound waveform conducted by a CPU of the sampler.
Figure 4A:
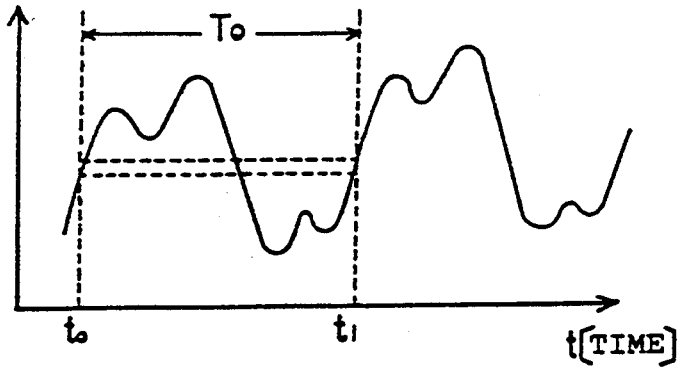
FIGS. 4A–4D are explanatory views showing sound waveform at each stage of the looping process executed by the process explained in FIG. 3.

First, a sound waveform shown in FIG. 4A is read out from the memory device 3. In the sound waveform of FIG. 4A, substantially one cycle of the waveform is indicated as To from a beginning region at time t0 to an ending region at time t1. As can be seen in the figure, the amplitude at the time t0 does not correspond to that of the time t1. Thus, a smooth loop cannot be formed at these regions. Next, the read-out sound waveform is indicated on the indication panel 13, and the cycle To is cut out from the sound waveform. The looping process is executed for the cycle To thus obtained according to the flowchart in FIG. 3.

Figure 4B:
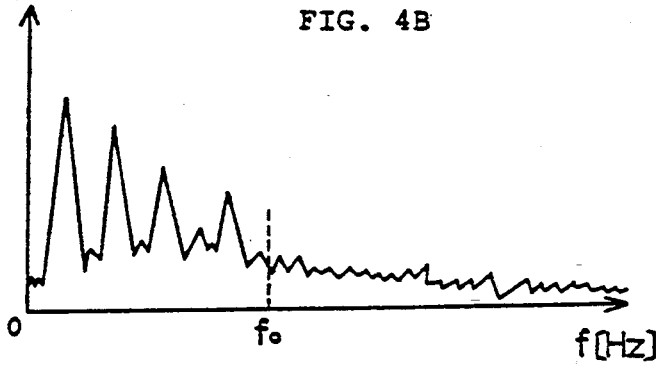

The CPU 11 applies a fast Fourier transform ("FFT") as a discrete Fourier transform to the cycle To (Step 301). The FFT is applied to a whole number of cycles of the input sound waveform. FIG. 4B shows the spectrum values at each discrete frequency point of the FFT-applied waveform in FIG. 4B corresponding to the signal values at each discrete time in FIG. 4A.

A FFT is a method for conducting a discrete Fourier transform more rapidly. The number of times of computation in FFT is reduced by applying an algorithm "decimation-in-time" to the discrete Fourier transform. The FFT is obtained from the discrete Fourier transform by the following steps. First, a discrete Fourier transform is conducted utilizing the following formula (2):

$$X(k)\mathrm{j} = \sum_{n=0}^{N-1} x(n)\, W_n^{kn},\ 0 \leqq k \leqq N-1 \tag{2}$$

$$(W_N = e^{-j\frac{2\pi}{N}})$$

wherein N is the number of sampling points, x(n) is an input waveform, and x(k) is an output waveform. Supposing $N=2^d$ ($\alpha$: whole number), the formula (2) can be modified into the following equation (3) in consideration of the point whether the n of the sequence x(n) is an odd or an even number.

$$X(k) = \sum_{n=0}^{N/2-1} x(2n)\, W_N^{2\pi k} + \sum_{n=0}^{N/2-1} x(2n+1) W_N^{(2n+1)k} \tag{3}$$

An equality (4) has been established with respect to $W_N{}^2$:

$$W_N{}^2 = e^{mj2(2\pi/N)} = e^{-j(2\pi/(N/2))} = W_{N/2} \tag{4}$$

Thus, the formula (3) can be modified into the following formulae (5-1, 5-2 and 5-3).

$$X(k) = G(k) + W_N{}^k H(k) \tag{5-1}$$

$$G(k) = \sum_{n=0}^{N/2-1} x(2n) W_{N/2}^{nk} \tag{5-2}$$

$$H(k) = \sum_{n=0}^{N/2-1} x(2n+1) W_{N/2}^{nk} \tag{5-3}$$

As is apparent, the formula (2) is divided into the formula (5-2) and (5-3) setting the number of sampling points at N/2, thereby obtaining two discrete Fourier transforms of N/2. The algorithm "decimation-in-time" of FFT is conducted by effecting this dividing operation successively. Thus, while the discrete Fourier transform requires the computation number of times of order (Nlog2N), FFT requires that of only order (N).

Figure 4C:
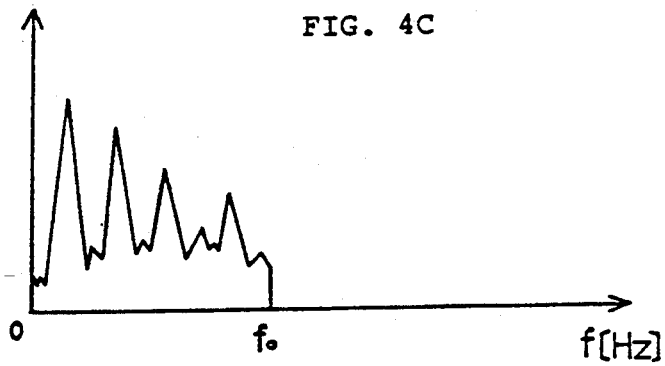

All frequencies higher than a given frequency point f0 are removed from the FFT-applied waveform (Step 303). The frequency f0 is about 10 kHz in the embodiment. The frequency f0 can be adjusted according to an input sound waveform. The resulting waveform is shown in FIG. 4C. Subsequently, an inverse fast Fourier transform ("IFFT") applied as an inverse discrete Fourier transform is applied to the waveform obtained at Step 303 (Step 305).

Inverse discrete Fourier transform is conducted by the following formula (6):

$$x(n) = \frac{1}{N} \sum_{k=0}^{N-1} X(k)\, W_N^{kn},\ 0 \leqq n \leqq N-1 \tag{6}$$

Similar to FFT, IFFT also reduces the number of times of computation of the inverse Fourier discrete transform, and thus the explanation of the formulae executed in IFFT is omitted herein.

Figure 4D:
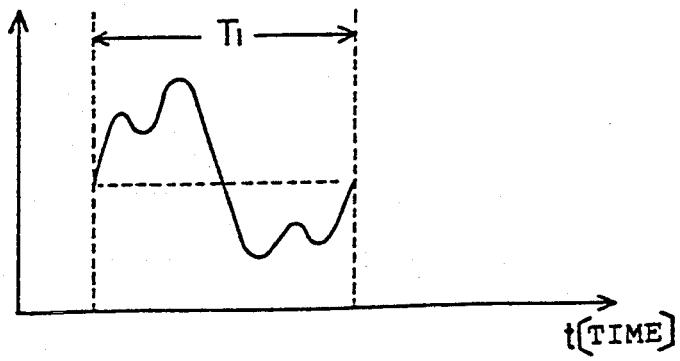
Figure 5A:
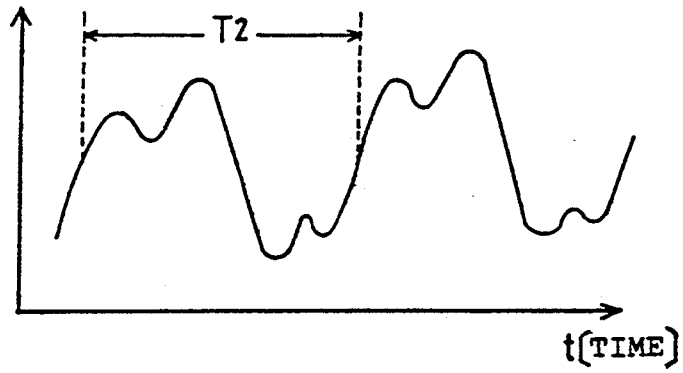
FIGS. 5A–5D are explanatory views showing sound waveforms at each stage of a looping process executed in an electronic sound processing system of the prior art.
Figure 5B:
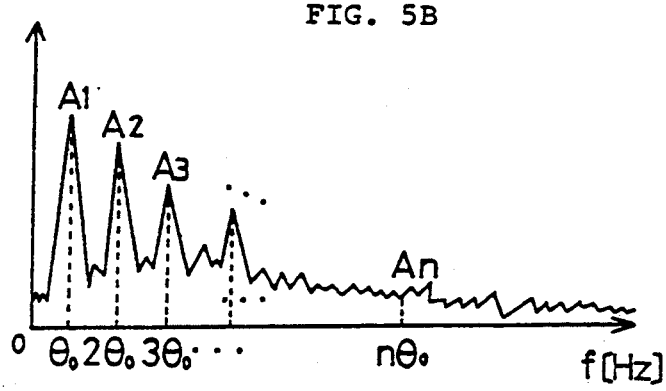
Figure 5C:
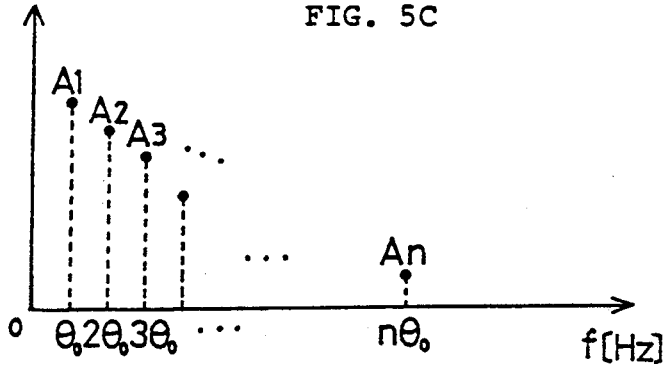
Figure 5D:
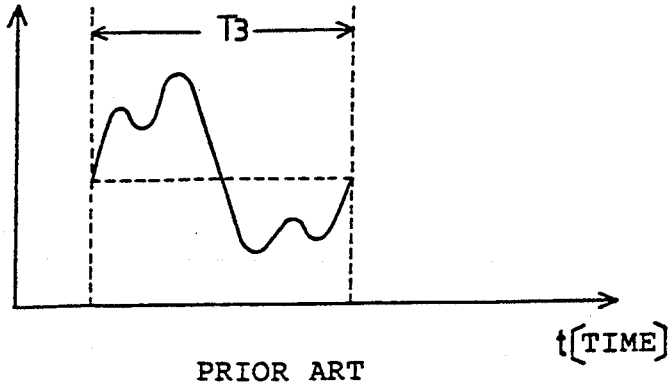

Finally, IFFT-applied one cycle T1 of the waveform is stored in the memory device 3 (Step 307). FIG. 4D shows the cycle T1 after the application of the IFFT. The cycle T1 stored in the memory device 3 is repeatedly read out by the CPU 11 and the sound control device 7 functioning as the looping process means, and is looped to become a looped waveform. The looped waveform thus obtained is then sent through the sound control device 7 to the sound input/output device 9.

As aforementioned, at the looping process of the electronic sound processing system of the invention, the application of a FFT facilitates the removal of a high frequency band from sound waveforms without the necessity of a low-pass filter. Furthermore, since the application of FFT and IFFT do not require complicated processes and special equipment, the cost can be greatly reduced compared with a prior art sampler or sound processing system having a low pass filter. Moreover, any special equipment and complicated techniques required for the looping process of conventional electronic pianos and synthesizers are not necessary for the sound processing system of the present invention. Even without adopting such complicated methods, the electronic sound processing system of the present invention can easily obtain smooth looped sound waveforms.

The present invention may be subjected to many modifications and charges without departing from the spirit or essential characteristics and scope thereof. For example, FFT and IFFT are applied in the software process of the CPU 11 in the preferred embodiment, but can be applied in hardware having logical circuits and other electrical circuits or in the combination of software and hardware.

What is claimed is:

1. An electronic sound processing system, including sound waveform looping, for processing a looped sound waveform and overcoming discontinuity at connection points of the looped sound waveform, said system comprising:

means for selecting a portion of an input sound waveform to be processed, said portion of an input sound waveform including a beginning region and an ending region; and sound waveform looping means, coupled to said means for selecting a portion of an input sound waveform and responsive to said selected portion of an input sound waveform to be processed, for looping between the ending region of said selected portion of an input sound waveform and the beginning region of said selected portion of an input sound waveform and forming an improved looped sound waveform;

said sound waveform looping means comprising:

discrete Fourier transform means for applying a discrete Fourier transform to the selected portion of said input sound waveform;

frequency band removal means, coupled to said discrete Fourier transform means and responsive to said portion of an input sound waveform to which said discrete Fourier transform was applied, for automatically removing from the discrete Fourier transformed input sound waveform all frequencies above a given frequency;

inverse discrete Fourier transform means, coupled to said frequency band removal means and responsive to said portion of said input sound waveform having all frequencies above a given frequency removed, for applying an inverse discrete Fourier transform to the input sound waveform from which said frequencies above a given frequency band were removed; and looping means, coupled to said inverse discrete Fourier transform means, for looping between said ending region and said beginning region of said input sound waveform to which said inverse discrete Fourier transform was applied.

2. The system of claim 1 wherein said looped sound waveform processing device includes a sound emitting device.

3. The system of claim 1 wherein said selected portion of an input sound waveform, between the ending region and the beginning region to be looped by said sound waveform looping means, is a whole number of cycles of the input sound waveform.

4. The system of claim 1 wherein said electronic sound processing system processes musical sound.

5. The system of claim 4 wherein said electronic sound processing system includes a synthesizer coupled to a musical instrument.

6. The system of claim 1 wherein said discrete Fourier transform and said inverse discrete Fourier transform are both fast Fourier transforms.

7. The system of claim 1 wherein the given frequency is 10 kHz.

8. The system of claim 1 wherein the frequency band removed by the frequency band removal means covers any frequencies higher than a predetermined frequency.

9. The system of claim 8 wherein said predetermined frequency can be adjusted according to an input sound waveform.

* * * * *